US005351636A

United States Patent [19]

Hirose

[11] Patent Number: 5,351,636

[45] Date of Patent: Oct. 4, 1994

[54] FULLY ROTATING HOOK FOR A LOCKSTITCH SEWING MACHINE

[75] Inventor: Tokuzo Hirose, Ashiya, Japan

[73] Assignee: Hirose Manufacturing Co., Ltd., Osaka, Japan

[21] Appl. No.: 84,519

[22] Filed: Jul. 1, 1993

[30] Foreign Application Priority Data

Mar. 12, 1993 [JP] Japan ..... 5-052554

[51] Int. Cl.[5] ..... D05B 57/16

[52] U.S. Cl. ..... 112/231

[58] Field of Search ..... 112/230, 231, 228, 181, 112/184, 185, 196, 232, 256

[56] References Cited

U.S. PATENT DOCUMENTS 4,638,750 1/1987 Mikuni .
4,700,643 10/1987 Hirose et al. ..... 112/231
4,858,543 8/1989 Badillo ..... 112/231
4,966,088 10/1990 Badillo .
5,188,046 2/1993 Badillo ..... 112/231

FOREIGN PATENT DOCUMENTS 728247 4/1955 United Kingdom ..... 112/231

*Primary Examiner*—Clifford D. Crowder
*Assistant Examiner*—Paul C. Lewis
*Attorney, Agent, or Firm*—Wenderoth, Lind & Ponack

[57] ABSTRACT

The friction coefficient between a track projection of an inner bobbin case holder and a track groove of an outer loop taker is reduced so that the outer loop taker can be rotated a small torque. One portion of the inner bobbin case holder opposite to a needle location is made of a synthetic resin or a synthetic resin containing metal powder carbon fiber, glass grains, ceramic powder or the like.

25 Claims, 7 Drawing Sheets

FULLY ROTATING HOOK FOR A LOCKSTITCH SEWING MACHINE

BACKGROUND OF THE INVENTION

1. Field of the Invention

The present invention relates to a fully rotating hook for a lockstitch sewing machine, such as a vertically fully rotating hook and a vertical axis fully rotating hook.

2. Description of the Related Art

Since a conventional fully rotating hook for a sewing machine is made of steel, there is a large coefficient of friction between a track projection of an inner bobbin case holder (hereinafter, often referred to merely as "bobbin case holder") and a track groove of an outer loop taker into which the track projection is fitted. In order to improve sewing quality, it is required to reduce the torque necessary for rotating the outer loop taker.

SUMMARY OF THE INVENTION

It is an object of the invention to provide a fully rotating hook for a lockstitch sewing machine in which the coefficient of friction between a track projection of a bobbin case holder and a track groove of an outer loop taker is reduced so that the outer loop taker can be rotated by a small torque.

The fully rotating hook for a lockstitch sewing machine of the invention is characterized in that one portion of an inner bobbin case holder of the lockstitch sewing machine, which portion is in a side opposite to a needle location, is made of (a) a synthetic resin, or (b) a synthetic resin containing metal powder, carbon fiber, glass grains, ceramic powder or the like.

Moreover, the invention is characterized in that the other portion of the bobbin case holder is made of (c) a metal, (d) a synthetic resin containing metal powder or ceramic powder, or (e) an inorganic material, and is integrated with the one portion to form the bobbin case holder.

Moreover, the invention is characterized in that the rotating shuttle is one selected from the group consisting of a vertically fully rotating hook and a vertical axis fully rotating hook.

Moreover, the invention is characterized in that the synthetic resin is a liquid crystal polymer.

Moreover, the invention is characterized in that the synthetic resin is high-density polyethylene containing a lubricant.

Moreover, the invention is characterized in that the inorganic material is a material in which alumina powder is scattered in aluminum alloy powder.

According to the invention, one portion of an inner bobbin case holder of a lockstitch sewing machine, which portion is in the side opposite to the needle location, is made of (a) a synthetic resin, or (b) a synthetic resin containing metal powder, carbon fiber, glass grains, ceramic powder or the like. Therefore, the coefficient of friction between the track projection of the bobbin case holder and the track groove of the outer loop taker is reduced so that the torque necessary for rotating the outer loop taker is reduced, thereby allowing the outer loop taker to smoothly and stably rotate at a high speed. This enables sewing quality to be improved.

Moreover, according to the invention, the portion of the bobbin case holder other than the one portion is made of (c) a metal, (d) a synthetic resin containing metal powder or ceramic powder, or (e) an inorganic material, thereby resulting in improved strength.

As described above, according to the invention, the coefficient of friction between the track projection and the track groove can be reduced, the torque necessary for rotating the outer loop taker can be reduced, the outer loop taker can be smoothly and stably rotated at a high speed, and the sewing quality can be improved.

Moreover, according to the invention, the inner bobbin case holder can be of reduced weight, smooth and high speed rotation of the outer loop taker can be realized without use of a lubricant, and the sewing quality can be improved.

BRIEF DESCRIPTION OF THE DRAWINGS

Other and further objects, features, and advantages of the invention will be made more explicit from the following detailed description taken with reference to the drawings wherein.

DETAILED DESCRIPTION OF THE PREFERRED EMBODIMENTS

Figure 1:
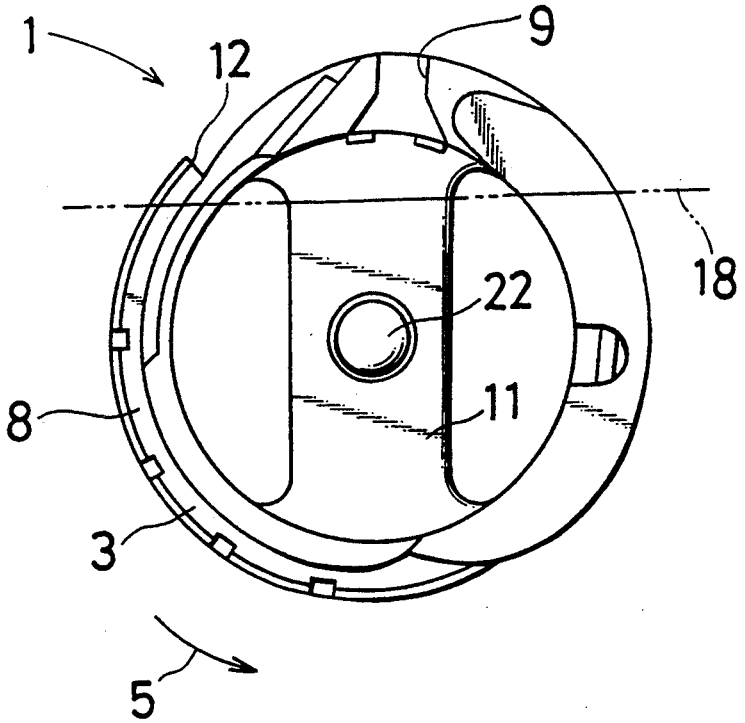
FIG. 1 is a front view of a bobbin case holder of a first embodiment of the invention.

Now referring to the drawing, preferred embodiments of the invention are described below.

Figure 2:
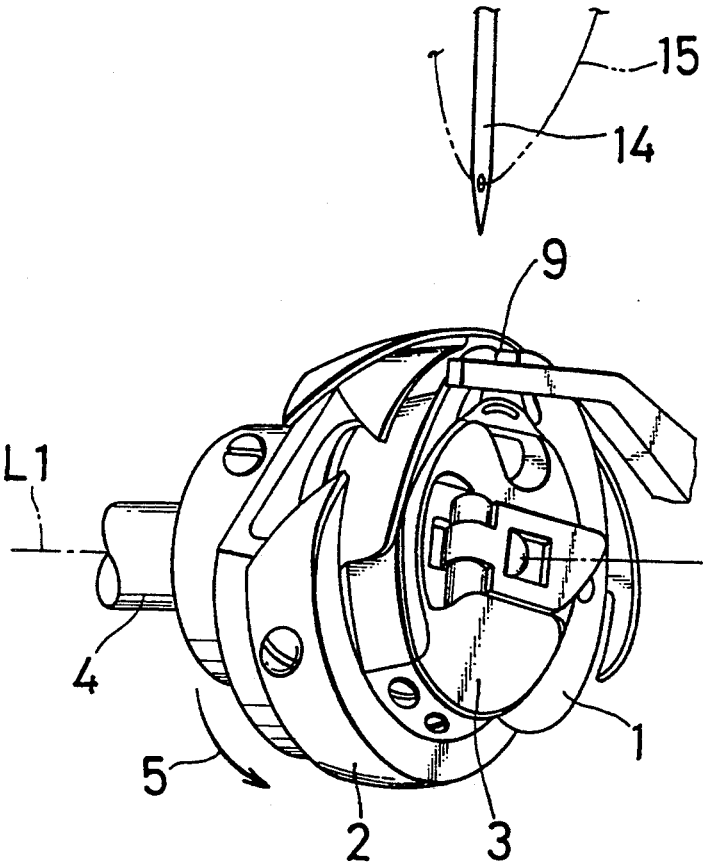
FIG. 2 is a perspective view showing the entire configuration of a vertically fully rotating hook including the bobbin case holder of FIG. 1.
Figure 3:
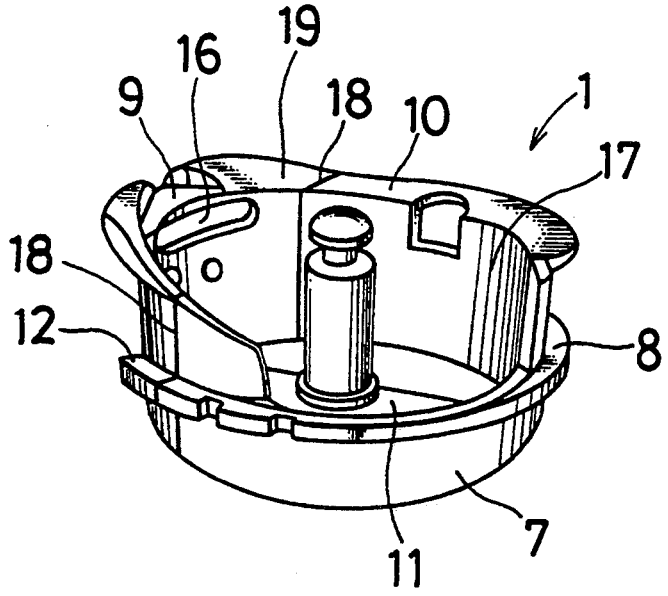
FIG. 3 is a perspective view of the bobbin case holder.
Figure 4:
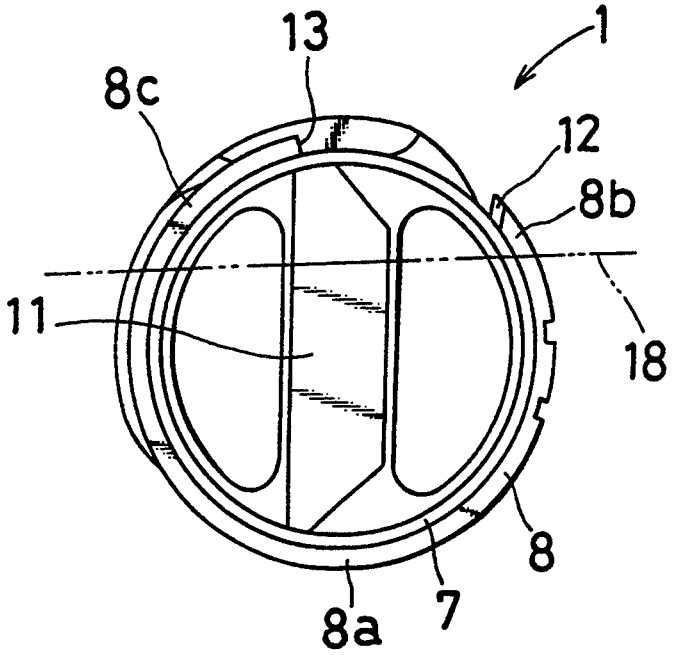
FIG. 4 is a rear view of the bobbin case holder.
Figure 5:
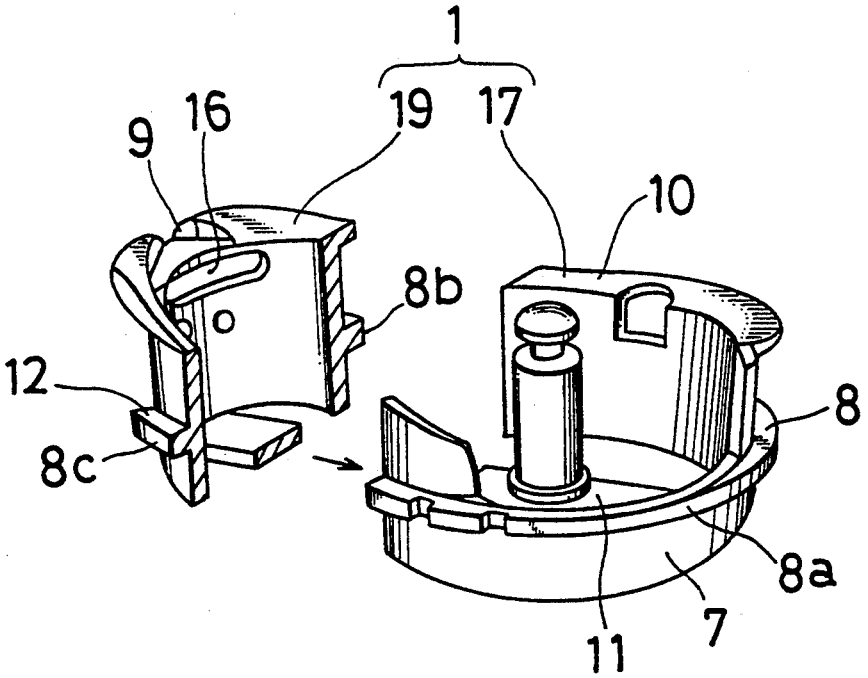
FIG. 5 is an exploded perspective view of the bobbin case holder of the first embodiment of the invention shown in FIGS. 1 to 4.
Figure 6:
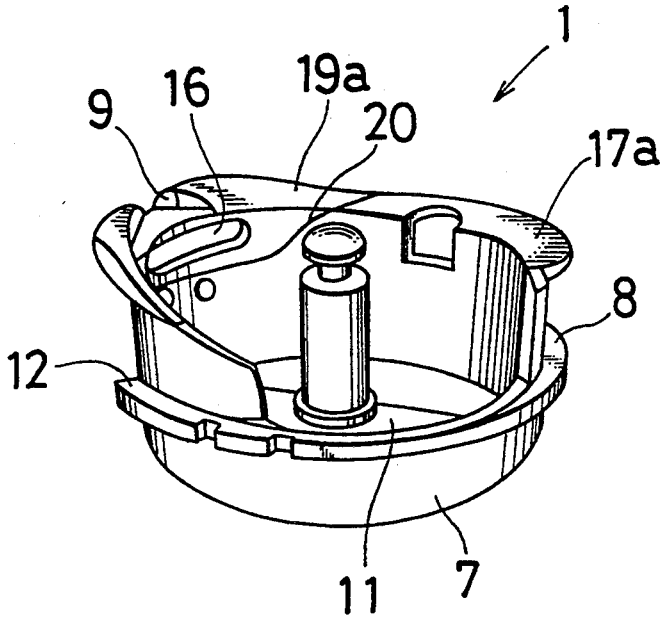
FIG. 6 is a perspective view of a second embodiment of the invention.
Figure 7:
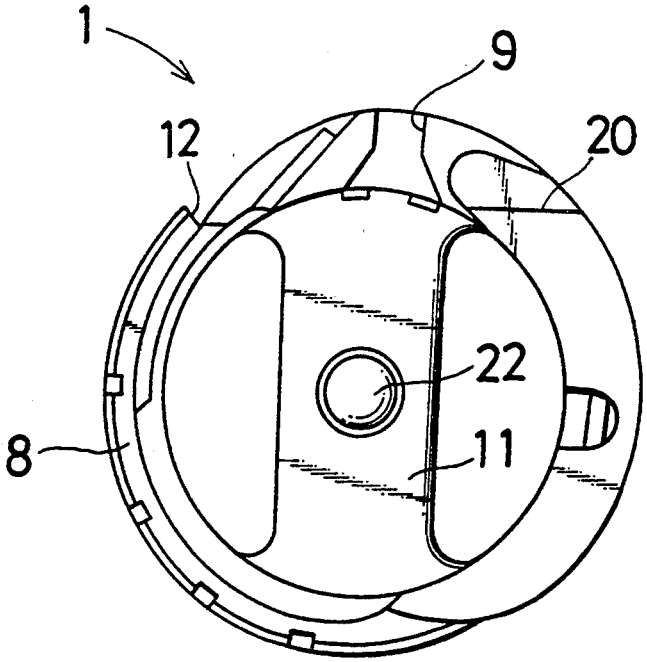
FIG. 7 is a front view of the bobbin case holder of the embodiment shown in FIG. 6.
Figure 8:
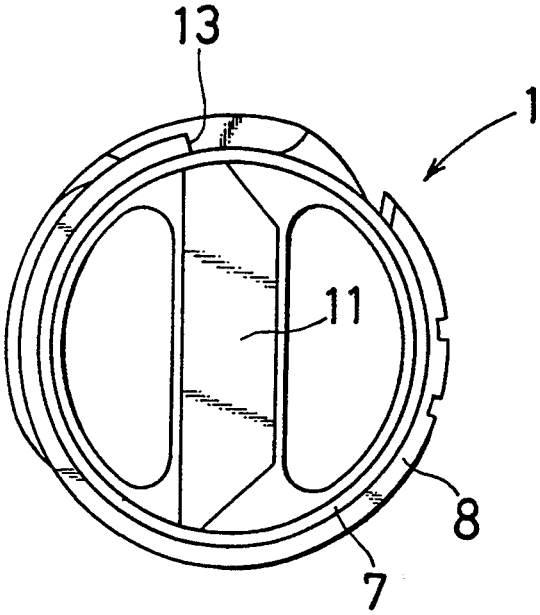
FIG. 8 is a rear view of the bobbin case holder of the embodiment shown in FIGS. 6 and 7.
Figure 9:
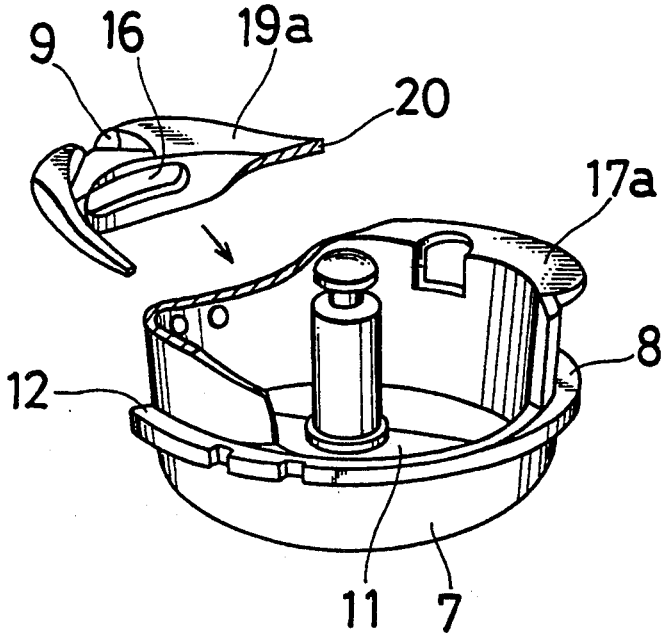
FIG. 9 is a fragmentary perspective view of the bobbin case holder of the second embodiment of the invention shown in FIGS. 6 to 8.

FIG. 1 is a front view of a bobbin case holder 1 used in a vertically fully rotating hook which is a first embodiment of the invention, FIG. 2 is a perspective view showing a state where the bobbin case holder 1 is installed in an outer loop taker 2 and a bobbin and a bobbin case 3 are housed therein, FIG. 3 is a perspective view of the bobbin case holder 1, and FIG. 4 is a rear view of the bobbin case holder 1. Referring to these figures, a rotation shaft 4 of the outer loop taker 2 is rotated in the direction indicated by arrow 5 about a horizontal axis L1. The bobbin case holder 1 comprises as basic components a cylinder 7, a track projection 8 formed on the outer periphery of the cylinder 7, a flange 10 which is formed at an end of the cylinder 7 and has a rotation restraining notch 9, and a bottom 11 formed at the other end of the cylinder 7. The track projection 8 has a loop spreading portion 12 and a thread releasing portion 13 respectively formed downstream and upstream, with respect to the rotation direction of the outer loop taker 2, of the rotation restraining notch 9. A stud 22 protrudes from the bottom 11 of the bobbin case holder 1. The stud 22 is inserted into a bobbin, and its front end is locked to the bobbin case 3. The track projection 8 is fitted into a track groove formed on the outer loop taker 2 which is rotated at a high speed. A needle 14 through which a needle thread 15 is passed is vertically reciprocated. A needle aperture 16 is formed in the bobbin case holder 1. One circumferential portion 17, in a portion or side opposite to the needle location is separated from another circumferential portion 19 at abutting joining surfaces by a horizontal section plane 18 which is parallel to the axis L1 of the bobbin case holder 1. The one portion 17 is made of (a) a synthetic resin, or (b) a synthetic resin containing metal powder, carbon fiber, glass grains, ceramic powder or the like.

The synthetic resin (a) consists of, for example, a liquid crystal polymer having rod-like stiff components in principal chains of polymers. Thus there exist large inter-molecular forces between the stiff chain components, and crystallization with excellent orientation is obtained upon shaping. Accordingly, the liquid crystal polymer has excellent heat resistance so that, even when the temperature is raised by friction caused by the outer loop taker 2 rotating at a high speed. A very high thermal deformation temperature prevents deformation from occurring. The liquid crystal polymer has excellent strength and has a high elastic modulus because it consists of stiff molecular chains and is highly oriented in the flowing direction upon shaping. Moreover, since molecular chains are arranged while they extend to their full length in the orientation direction, the liquid crystal polymer exhibits excellent creep characteristics in which the molecular chains do not lengthen further even when a tensile force is applied. The linear expansion coefficient of the liquid crystal polymer is very small. Particularly, the linear expansion coefficient in the flowing direction is as small as about $1\times10^{-5}$ cm/cm/°C. This linear expansion coefficient which is smaller by one figure than those of other synthetic resins enables the liquid crystal polymer to have a dimensional stability of the same degree as that of a metal, with the result that there occurs substantially no dimensional change due to differences in ambient temperature and humidity, such as environment differences between summer and winter. Moreover, the liquid crystal polymer has an excellent weatherability so that it can be used for a long period of time. In the liquid crystal polymer, since the structure in the molten state is similar to that in the solidified state, the phase change is small in degree, and also the volume change on solidifying is small.

The liquid crystal polymer has the property of damping vibration. Although a soft material such as rubber generally has an excellent vibration damping property, the liquid crystal polymer has an excellent vibration damping property while it has a high elastic modulus. In order to improve wear resistance, the liquid crystal polymer may be mixed with 30% of carbon fibers, thereby reducing specific abrasion wear and the coefficient of dynamic friction. The liquid crystal polymer consists of a copoplymer of parahydroxybenzoic acid and 2-hydroxy-6-naphthoic acid. Other useful materials for the liquid crystal polymer include a copolymer of two or three or more kinds of naphthalene groups used as one constituent, and another constituent. The naphthalene groups are compounds having functional groups at two or more substitution positions selected from 1- and 2-positions, 1- and 4-positions, 1- and 5-positions, 1- and 8-positions, 2- and 3-positions, 2- and 6-positions, and 2- and 7-positions. The functional groups may be any as long as they can form polyesters and/or polyester amides. In other words, the functional groups are selected from a hydroxy group, a carboxyl group, an amino group, an ester group, etc.

The naphthalene groups may be hydroxynaphthoic acid, dihydroxynaphthalene and/or naphthalenecarboxylic acid.

Constituents other than the naphthalene groups are formed by a p-position phenyl group, a 4, 4'-biphenyl group, and/or a compound represented by general formula 1: (where X is a group selected from alkylene (1 to 4 carbon atoms), alkylidene (1 to 4 carbon atoms), —O—, —S—, —SO—, —$SO_2$— and —CO—, and R and R' are reactive groups such as a hydroxy group and a carboxyl group or their esters) and their substitutive derivative. The bonding units of the polymer are preferably an ester and/or an ester amide, and functional groups forming them are selected from a hydroxy group, a carboxyl group, an amino group, an ester group, etc. Preferably, as the bonding units, selected are terephthalic acid, hydroquinone, p-diacetoxyphenylene, p-hydroxybenzoic acid, and their esters; 4, 4'-dihydroxybiphenyl, 4, 4'-dicarboxybiphenyl, 4-hydroxy-4'-carboxybiphenyl, and their esters; and a dihydroxy body, dicarboxyl body and hydroxycarboxy body where X of general formula 1 is methylene, propenyl or —$SO_2$—, and their esters, and more preferably, terephthalic acid, hydroxybenzoic acid, 4, 4'-dihydroxybiphenyl, 4, 4'-dihydroxybiphenyl, and their esters.

Even when the sewing operation is performed at a high speed and for a long period of time, the use of the one portion 17 consisting of such a liquid crystal polymer allows the abrasion wear of the surface of the track projection 8 to be reduced to a very low level, thereby remarkably improving durability. Moreover, the weight of bobbin case holder 1 is reduced so as to reduce the rotational torque which is to be applied to the lower shaft 4. This allows the motor for rotating the shaft 4 to be miniaturized.

Figure 13:
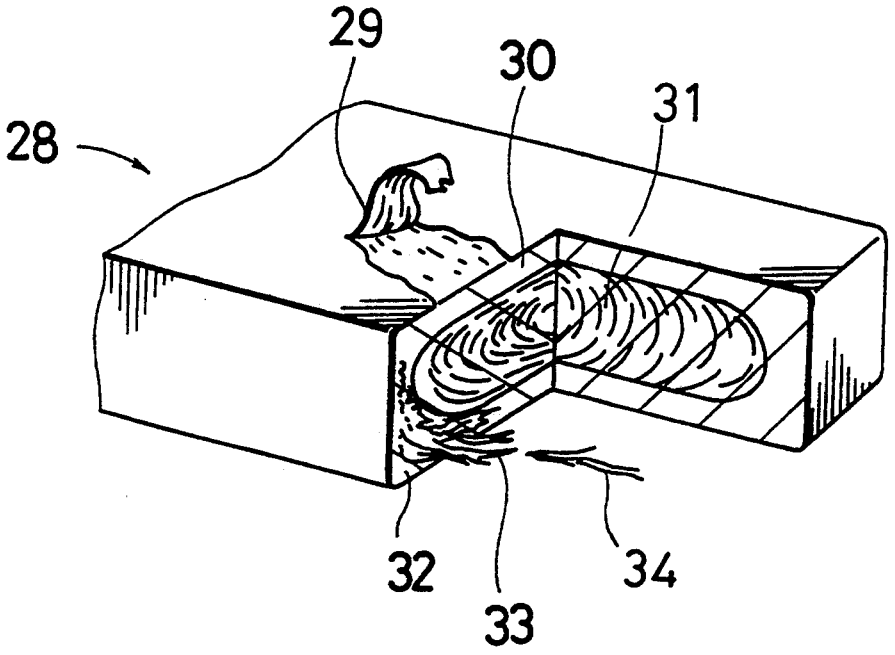
FIG. 13 is a perspective view showing the configuration of a liquid crystal polymer.

FIG. 13 shows a partial cutaway view of an injection-molded product 28 of a liquid crystal polymer. The liquid crystal polymer includes an outer skin 29 in which molecular chains are highly oriented in the flowing direction, an inner skin 30, and a core 31 in which the orientation is not clearly observed. The skins 29 and 30 are substantially constant in thickness or have a thickness of 0.3 to 0.2 mm irrespective of the thickness of the molded product. The liquid crystal polymer which has been plasticated by heating is injected into a closed mold, and after cooling and solidification the mold is opened and the molded product is removed therefrom. In this way, the portion 17, particularly a rib portion 8*a* of the bobbin case holder 1 can be produced by molding a liquid crystal polymer, thereby facilitating production and improving productivity.

Since the skins 29 and 30 are highly oriented in the flowing direction, the liquid crystal polymer has excellent mechanical properties such as high strength and a high modulus of elasticity. Since the liquid crystal polymer is easily oriented, however, it is liable to produce anisotropy. In order to weaken the anisotropy, it is preferable to introduce a reinforcing agent into stiff skeletons. This easy orientation is liable to produce fibrils peeled from the skins 29 and 30. The length of macrofibrils 32 is 5 μm, that of fibrils 33 is 0.5 μm, and that of microfibrils 34 is 0.05 μm. The liquid crystal polymer has a multilayer structure comprising the outer skin 29, the inner skin 30, the core 31, etc., and exhibits an excellent vibration damping property in spite of its high elastic modulus.

An example of the synthetic resin (b) containing metal powder, carbon fiber, glass grains, ceramic powder or the like is a complex of a synthetic resin and a metal. For example, the complex of a synthetic resin and a metal may be produced by charging fibers of a metal such as aluminum or brass into an epoxy resin. The thickness of the metal fibers is about 0.01 mm. This improves mechanical properties such as tensile strength and compressive strength. Specifically, when 35% of metal fibers are added, the tensile strength is increased about five times.

It is also preferable to use an injection molded epoxy resin in which aluminum powder or iron powder is charged into the epoxy resin. This improves mechanical strength.

In another example of this embodiment, a complex of a synthetic resin and carbon powder or carbon fibers may be used in place of the complex of a synthetic resin and a metal.

The one portion 17 may be made of a synthetic resin which is reinforced by mixing glass powder thereinto. A coating layer of ceramic may be formed on the surface of the one portion.

Generally, the ceramic is produced by press molding aluminum oxide ($Al_2O_3$) or a mixture of aluminum oxide and a small amount of another metal and a binder and by then sintering the molded piece. The hardness of the ceramic does not change until the temperature is raised to about 1,100° C. The ceramic has a specific heat about four times larger than a sintered hard alloy and a thermal conductivity about one half of a sintered hard alloy. The ceramic has a small thermal expansion. Although a sintered hard alloy is considerably oxidized and has changed properties at about 1,000° C. or higher, the ceramic is stable up to about 2,000° C. Since the ceramic has a weak affinity for most metals, the ceramic has properties that it hardly will be welded with another material and it has improved abrasion resistance.

The portion 17 of the bobbin case holder 1 in which a coating layer of such a ceramic is formed can be produced by injection molding.

Since the portion 17 can be produced by injection molding, the bobbin case holder 1 having a complex structure easily can be produced. That is, production of the bobbin case holder 1 can be very easily performed as compared with that of a prior art bobbin case holder which is made of a material such as iron. In order to further improve accuracy, the coating layer may be subjected to a machining operation. The coating layer may consist of a plurality of layers. In this alternative, a lower layer may be subjected to a machining operation, and thereafter an upper layer is formed so that the coating layer has a smooth outer surface or an outer surface without irregularities. Since the one portion 17 can be made of a material which is a mixture of a synthetic resin and glass powder as described above, the body can be produced by an injection molding technique using a mold, thereby remarkably improving productivity. Furthermore, since glass powder is mixed into the body, the body can be improved in strength compared with a body which is made of only a synthetic resin, and can be of reduced weight compared with parts made of a metal. Therefore, the total weight of a sewing machine in which this part is used can be reduced thus to realize a lightweight sewing machine.

Moreover, the coating layer is formed on the surface of the body made of a synthetic resin so as to constitute a part composed of plural types of materials. Accordingly, it is possible to prevent an abnormal phenomenon such as resonance from occurring, thereby to reduce noise level.

Since the coating layer is made of a ceramic, it has excellent heat resistance and abrasion resistance, resulting in that seizure or the like of sliding portions can be prevented from occurring. Moreover, since the coating layer made of a ceramic has a low friction coefficient, a thread can smoothly slide on portions such as the outer surface of the bobbin case holder, whereby the tension of the thread during sliding is prevented from randomly changing. The prevention of seizure and the reduction in abrasion wear can lengthen the life of the part, so that the durability is improved.

The coating layer may be formed by a process in which a first coating layer is formed on the surface of the body, the first coating layer is machined, and thereafter a second coating layer made of a ceramic is formed on the surface of the first coating layer. According to this process, the second coating layer can be formed on the first coating layer which has been machined so as to be approximately flat, with the result that the surface of the second coating layer has substantially no irregularities. This configuration minimizes the amount of polishing, reduces waste of a material, and allows a predetermined thickness of the coating layer to be realized by the thicknesses of the thin first and second coating layers. The other portion 19 is made of (c) a metal, (d) a synthetic resin containing metal powder or ceramic powder, or (e) an inorganic material. The other portion 19 is integrated with the one portion 17 by an adhesive or a mechanical configuration such as a partial fitting, to from the bobbin case holder 1.

For example, the metal may be stainless steel or steel. Furthermore, a coating layer of TiAlN or TiCN may be formed with a thickness of 5 to 5 μm.

The synthetic resin containing metal powder or ceramic powder may be the same as the material which has been described in conjunction with the one portion 17.

The inorganic material is, for example, a material in which alumina powder is scattered in aluminum alloy powder. The inorganic material has properties that wear resistance is high, reduction in strength is small even at elevated temperature, and workability is excellent. The aluminum alloy powder may be manufactured by the following process. An aluminum alloy, such as A2000 series containing steel, magnesium, nickel and iron, is powdered, and 2 to 5% of alumina powder of a particle size of about 5 microns is added to the aluminum alloy powder and mixed therewith. The mixture is subjected to press molding, and thereafter is subjected to hot extrusion at 400° C. to form a rod-like billet. The thus obtained aluminum alloy billet is shaped into a predetermined shape by, for example, cold forging, and a finishing operation such as polishing is conducted on the shaped product. The portion 19 of the bobbin case holder which is made of such an aluminum alloy is subjected to, for example, quenching and tempering operations after cold forging, and has a wear resistance which is about 100 times that of carbon steel. Tensile strength is 36 kg/cm$^2$ at 150° C., or equivalent to that of carbon steel at room temperature or five times that of pure aluminum.

Even when a sewing operation using the thus configured bobbin case holder 1 is performed at a high speed and for a long period of time, the abrasion wear of the track projection 8 is at a very low level, thereby remarkably improving durability.

The track projection 8 consists of the rib portion 8*a* in the one portion 17 and rib portions 8*b* and 8*c* in the other portion 19. The needle aperture 16 and the vicinity thereof are formed in the other portion 19.

FIGS. 6 to 9 show a second embodiment of the invention. The portions of this embodiment corresponding to those of the above-described embodiment are denoted by the same reference numerals. In this embodiment, the bobbin case holder 1 consists of one portion 17*a* and another portion 19*a*, the other portion 19 includes only the needle aperture 16 and the vicinity thereof, and the two portions 17*a* and 19*a* are fixed to each other at abutting joining surfaces along a section line 20.

Figure 10:
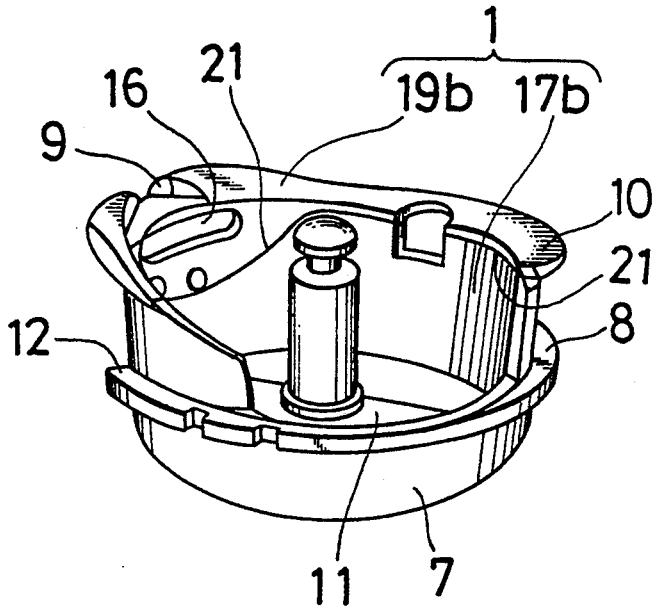
FIG. 10 is a perspective view of a bobbin case holder of a third embodiment of the invention.
Figure 11:
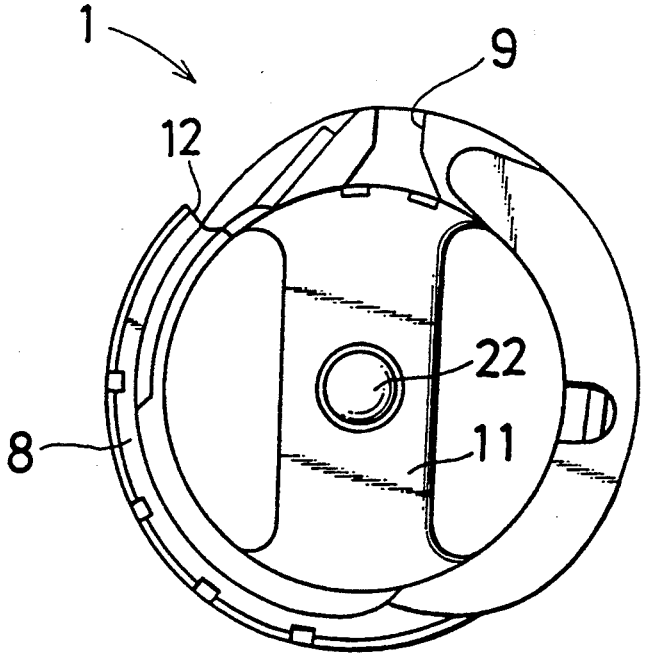
FIG. 11 is a front view of the bobbin case holder of the third embodiment shown in FIG. 10.
Figure 12:
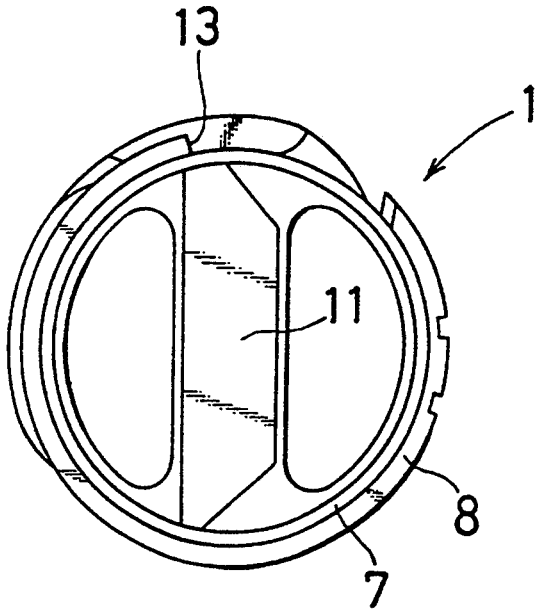
FIG. 12 is a rear view of the bobbin case holder of the third embodiment shown in FIGS. 10 and 11.

FIGS. 10 to 12 show a third embodiment of the invention. This embodiment is similar to the above-described embodiments, and corresponding portions are denoted by the same reference numerals. In this embodiment, one portion 17*b* and another portion 19*b* are fixed to each other at abutting joining surfaces along a section line 21. The other portion 19*b* includes the needle aperture 16 and the vicinity thereof and the flange 10.

The invention can be applied not only to a vertically fully rotating hook and a vertical axis fully rotating hook but also to a wide range of other structures, including an oscillating loop taker, etc.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and the range of equivalency of the claims are therefore intended to be embraced therein.

What is claimed is:

1. In a fully rotating hook for a lockstitch sewing machine and including an inner bobbin case comprising a cylinder extending in an axial direction, a bottom at a first axial end of said cylinder, a flange at a second axial end of said cylinder, a track projection extending outwardly from said cylinder at a position spaced from said first and second axial ends, and a needle aperture in said cylinder at a position between said track projection and said second axial end, the improvement comprising:

said inner bobbin case including first and second portions formed separately of respective different first and second materials and joined integrally at abutting joining surfaces;

said joining surfaces being defined along a plane extending parallel to the longitudinal axis of said cylinder;

said first portion including said needle aperture and a portion of said flange;

said second portion including a remaining portion of said flange;

said second material comprising synthetic resin.

2. The improvement claimed in claim 1, wherein each of said first and second portions include respective parts of said cylinder, said bottom and said track projection.

3. The improvement claimed in claim 1, wherein said synthetic resin contains metal powder, carbon fibers, glass grains or ceramic powder.

4. The improvement claimed in claim 1, wherein said first material of said first portion comprises a metal.

5. The improvement claimed in claim 1, wherein said first material of said first portion comprises synthetic resin containing metal powder or ceramic powder.

6. The improvement claimed in claim 1, wherein said first material of said first portion comprises inorganic material.

7. The improvement claimed in claim 6, wherein said inorganic material comprises aluminum alloy powder having therein aluminum powder.

8. The improvement claimed in claim 1, wherein said synthetic resin comprises a liquid crystal polymer.

9. The improvement claimed in claim 1, wherein said synthetic resin comprises high density polyethylene containing a lubricant.

10. In a fully rotating hook for a lockstitch sewing machine and including an inner bobbin case comprising a cylinder extending in an axial direction, a bottom at a first axial end of said cylinder, a flange at a second axial end of said cylinder, a track projection extending outwardly from said cylinder at a position spaced from said first and second axial ends, and a needle aperture in said cylinder at a position between said track projection and said second axial end, the improvement comprising:

said inner bobbin case including first and second portions formed separately of respective different first and second materials and joined integrally at abutting joining surfaces;

said first portion including said needle aperture and a portion of said flange, extending at said second axial end along only a minor part of the circumference of said cylinder, and extending axially from said needle aperture only to a position between said track projection and said second end;

said second portion including a remaining portion of said flange said second material comprising synthetic resin.

11. The improvement claimed in claim 10, wherein said synthetic resin contains metal powder, carbon fibers, glass grains or ceramic powder.

12. The improvement claimed in claim 10, wherein said first material of said first portion comprises a metal.

13. The improvement claimed in claim 10, wherein said first material of said first portion comprises synthetic resin containing metal powder or ceramic powder.

14. The improvement claimed in claim 10, wherein said first material of said first portion comprises inorganic material.

15. The improvement claimed in claim 14, wherein said inorganic material comprises aluminum alloy powder having therein aluminum powder.

16. The improvement claimed in claim 10, wherein said synthetic resin comprises a liquid crystal polymer.

17. The improvement claimed in claim 10, wherein said synthetic resin comprises high density polyethylene containing a lubricant.

18. In a fully rotating hook for a lockstitch sewing machine and including an inner bobbin case comprising a cylinder extending in an axial direction, a bottom at a first axial end of said cylinder, a flange at a second axial end of said cylinder, a track projection extending outwardly from said cylinder at a position spaced from said first and second axial ends, and a needle aperture in said cylinder at a position between said track projection and said second axial end, the improvement comprising:

said inner bobbin case including first and second portions formed separately of respective different first and second materials and joined integrally at abutting joining surfaces;

said first portion including said needle aperture and said flange and extending at said second axial end along only a part of the circumference of said cylinder and extending axially from said needle aperture to a position between said track projection and said second end; and said second material comprising synthetic resin.

19. The improvement claimed in claim 18, wherein said synthetic resin contains metal powder, carbon fibers, glass grains or ceramic powder.

20. The improvement claimed in claim 18, wherein said first material of said first portion comprises a metal.

21. The improvement claimed in claim 18, wherein said first material of said first portion comprises synthetic resin containing metal powder or ceramic powder.

22. The improvement claimed in claim 18, wherein said first material of said first portion comprises inorganic material.

23. The improvement claimed in claim 22, wherein said inorganic material comprises aluminum alloy powder having therein aluminum powder.

24. The improvement claimed in claim 18, wherein said synthetic resin comprises a liquid crystal polymer.

25. The improvement claimed in claim 18, wherein said synthetic resin comprises high density polyethylene containing a lubricant.

* * * * *